US006374594B1

(12) United States Patent
Kraft et al.

(10) Patent No.: US 6,374,594 B1
(45) Date of Patent: Apr. 23, 2002

(54) SILO/CAN-ANNULAR LOW EMISSIONS COMBUSTOR

(75) Inventors: Robert J. Kraft, Palm City; Vincent C. Martling, West Palm Beach; Brian R. Mack, Palm City; Mark A. Minnich, West Palm Beach; Timothy J. teRiele, Palm City, all of FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 0 days.

(21) Appl. No.: 09/614,577

(22) Filed: Jul. 12, 2000

(51) Int. Cl.[7] ..... F02C 3/00; F02G 3/00
(52) U.S. Cl. ..... 60/39.37; 60/732; 60/739
(58) Field of Search ..... 60/39.37, 732, 60/739, 746, 747

(56) References Cited

U.S. PATENT DOCUMENTS 4,073,134 A * 2/1978 Koch ..... 60/39.29
6,094,916 A * 8/2000 Puri et al. ..... 60/737

* cited by examiner

*Primary Examiner*—Charles G. Freay
(74) *Attorney, Agent, or Firm*—Malin, Haley & DiMaggio, P.A.

(57) ABSTRACT

A gas turbine engine for generating electricity having low NOx emissions that includes a turbine system linearly and axially connected by a power shaft to a compressor section and having a combustion section mounted vertically relative to the turbine section and the compressor section. The combustion system includes a plurality of individual combustors mounted in a circular or annular array around the upper cap or dome of the combustion system, each of said combustors being a dual mode, two-stage, emitting low levels of NOx. Each combustor exhausts its combustion gases into a common central plenum chamber that is vertically oriented relative to the turbine engine centerline. The plenum provides the hot gases to the turbine blades through an annular chamber 360 degrees around the shaft. The gas turbine engine vertical combustion system provides for a highly efficient, low nitric oxide emissions while allowing for uniform mixing of the combusting gases powering the turbine system.

2 Claims, 6 Drawing Sheets

SILO/CAN-ANNULAR LOW EMISSIONS COMBUSTOR

BACKGROUND OF THE INVENTION

1. Field of the Invention

This invention relates to a silo type combustor for a gas turbine engine used to provide rotational power to an electrical generator, and specifically to a gas turbine engine with a silo combustor that operates at very reduced levels of nitric oxide (NOx) emissions.

2. Description of Related Art

In recent years, emissions regulations with the Federal Government has become of great concern to manufacturers and operators of gas turbine engines used to generate electricity, and, in particular, of pollutants produced by the gas turbine combustor. Of specific concern are nitric oxides (NOx) because of their large contribution to air pollution. Depending upon the gas turbine installation site, emission requirements vary, in terms of parts per million (ppm) of NOx that can be emitted each year. Therefore if a particular gas turbine engine is used very little in a year, a higher emissions combustor can be used. However if a gas turbine engine is run on a regular basis, a lower emission combustor system is required to meet emission regulations. In the past, NOx emissions have been reduced by the injection of water or steam in to the combustion process. Although this is an acceptable process, it has many disadvantages including system complexity, the cost of water treatment and increased heat rates. In order to meet pollution emission requirements without using one of the previously mentioned options, operators of gas turbines are required to upgrade older, higher pollutant emitting engines to include a combustion system that emits a lower level of NOx than their existing systems. Each engine manufacturer has taken steps to provide a combustion system capable of reducing NOx emissions to acceptable levels. Most common low emission combustors use natural gas instead of liquid fuel and have improved airflow, cooling, and mixing conditions.

Gas turbine engines have certain essential components such as a combustor, a compressor section, a turbine section and the power shaft. Gas turbine combustors vary in geometric configuration, fuel nozzle arrangement, fuel utilized and emission results. For example, one particular gas turbine engine utilizes a "silo" combustor which is stacked vertically above the engine centerline. Older, higher emitting combustor arrangements can use one liquid fuel nozzle for mixing liquid fuel and compressor discharge air. This combustor arrangement typically produces emissions in excess of new environmental regulations. The present invention provides an improved combustor system using the silo configuration to produce low emissions for a natural gas turbine engine. U.S. Pat. No. 4,292,801 describes a gas turbine engine that employs a horizontal combustor mounted in line with the turbine section and the compressor section.

The use of a silo combustor can result in a more compact turbine engine, saving space, and providing for operational improvements due to its mounting and location relative to the turbine and compressor sections of the engine. In addition the silo plenum allows for improved fuel/air mixture and a uniform pattern prior to the turbine section.

U.S. Pat. No. 5,611,197 issued to Bunker Mar. 18, 1997 shows a closed circuit air cooled turbine. Each combustor 20 is mounted offset from the power shaft such that the output of each of the combustors is directed to a small area of the turbine blades. A plurality of combustors are utilized, each having an output at a different area of the turbine blades.

Utilizing the silo orientation of the present invention, a 360 degree output covering the entire turbine blade section can be achieved using a plurality of individual combustors as described further herein.

BRIEF SUMMARY OF THE INVENTION

A gas turbine engine used for providing power to operate an electrical generator typically for a utility grid comprising a silo combustion system that includes a plurality of two-stage, two-mode combustors for producing low NOx emissions, a turbine system driven by the exhaust gases from said combustion system for providing rotational energy, and a compressor system providing compressed air to said combustion system, said turbine system including an output shaft used to drive a generator as well as the compressor system.

The turbine system and the compressor system are joined by the operating shaft mounted horizontally and linearly in the overall turbine engine housing.

The combustion system is mounted vertically between said turbine system and said compressor system and includes a combustion gas output channel that communicates directly with the turbine blades providing high velocity exhaust gases that are used to drive the turbine blades.

The vertically mounted combustion system includes a plurality of individual combustors mounted on a top cap through annular openings in the top cap of the combustion system. In the embodiment disclosed herein, a plurality of twelve individual combustors are mounted in a ring (annularly) around the combustion top cap.

Each combustor is comprised of a two-stage, two-mode combustor that includes six primary fuel nozzles and one secondary, centrally-located fuel nozzle to provide two-stage operation.

The exhaust gases from each combustor enters a common plenum chamber. The combusted gases under high pressure are directed through a transition channel into an annular chamber that is in 360 degree communication with the turbine blades. Thus the combustion gases which drive the turbine blades interact around a 360 degree area rather than having individual combustion gas feed chambers from each individual combustor as shown in the prior art. A common plenum chamber provides a more uniform exhaust pattern to the turbine, where as in prior art, individual exhaust ducts to sections of the turbine may differ in pressure, temperature and affect turbine performance.

The use of two-stage individual combustors results in very low NOx polluting emissions because of high efficiency of each combustor.

Each combustor also includes a venturi section within the combustion liner that utilizes an improved cooling air transfer system. This system cools the entire liner, including the venturi. While cooling the venturi, the air is preheated by radiation from the secondary combustion chamber, and is then directed into the upstream/premix combustion chamber for use in the combustion process. This additional air lowers the fuel/air ratio, which in turn lowers combustion flame temperature and emissions. The improved use of cooling air for a combustion liner for lowering emissions is disclosed in applicant's current pending U.S. patent application Ser. No. 09/605,765 which is hereby incorporated by reference into this application. The use of the improved device described above in applicant's patent application is used in all twelve combustors utilized in the present invention.

It is an object of this invention to provide an improved gas turbine engine used for generating electrical power that has low NOx pollutants and emissions while utilizing a combustion system that is vertically oriented and uses a common plenum exhaust gas chamber in fluid communication with the turbine blades.

It is another object of this invention to use a plurality of two-stage, two-mode combustors in a vertically oriented combustion system for use in a gas turbine engine to reduce NOx emissions while providing exhaust gases in a 360-degree fed chamber through the turbine blades.

Yet still another object of this invention is to provide an improved silo type combustor for a gas turbine engine that has a common plenum using a plurality of individual combustors of high efficiency.

But yet still another object of this invention is to provide a vertically oriented combustion chamber that includes two-stage, two-mode combustors with a vertically oriented combustion system to improve gas flow distribution throughout the combustion process.

In accordance with these and other objects which will become apparent hereinafter, the instant invention will now be described with particular reference to the accompanying drawings.

DETAILED DESCRIPTION OF THE INVENTION

Figure 1:
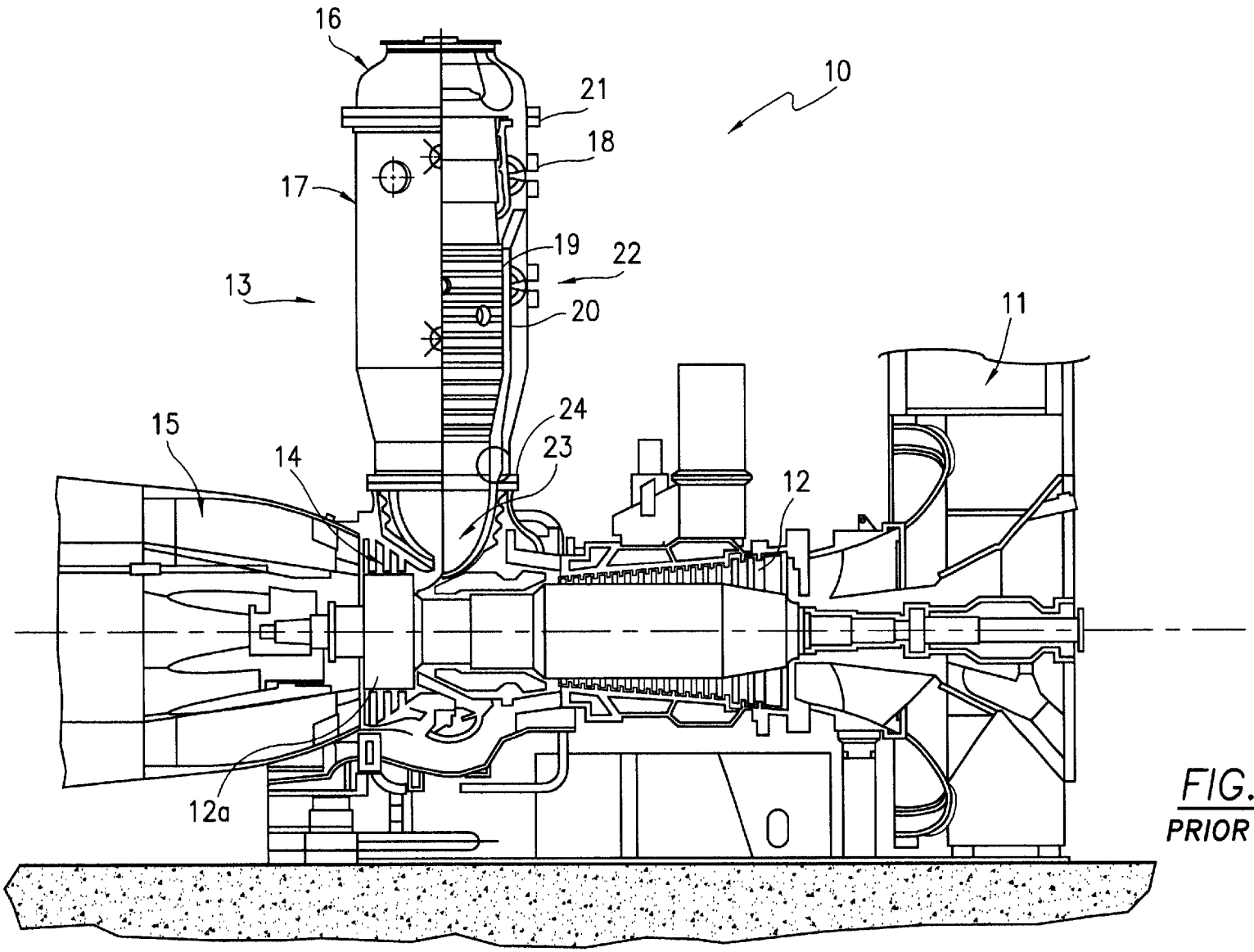
FIG. 1 PRIOR ART
FIG. 1 shows a side elevational view, partially in cross section of a gas turbine engine that includes a conventional silo combustion system, the turbine engine being used for generating electricity.

Referring now to FIG. 1, a conventional "silo" combustion system that is used in a gas turbine engine is shown. The gas turbine engine 10 will typically be used for generating electricity. The compressor system shown generally at 12 takes in air through the air inlet 11. The compressor then forces air under pressure into the combustion system 13. The compressor 12 is a multi-stage axial compressor of conventional design. The combustor system 13 provides combustion gases to turbine 14 which rotates shaft 12*a*, rotating the compressor blades in compressor 12 and the output shaft which provides rotational energy to an electrical generator (not shown) which is attached to said output shaft 12*a*. The compressor 12 is comprised of rotating and stationary airfoils in an alternating pattern and is conventional in design. The combustion system 13 includes an outer cylindrical wall 17, a middle liner 20 and a ribbed inner combustion liner 19. The outer walls of the combustion system 13 are joined by flanges 21 and 24. The combustion system 13 includes a combustion system cap 16 which is bolted to flange 21. Compressor 12 discharge air, which is used within the combustion system 13 during the combustion process, exits compressor 12 and travels upwardly along combustion system 13, between the inner liner 19 and middle liner 20 and between middle liner 20 and outer cylindrical wall 17. The high pressure compressor air then reverses direction at cap 16 where the air passes through a nozzle swirler arrangement (not shown) within the vertical silo area. Combustion occurs within the inner liner 19 based on a single one-stage, one-mode combustor and hot gases exit the combustor through area 23. These hot gases travel into the turbine 14 where the exhaust gases turn the rotor which is connected to shaft 12*a* used to generate power. The hot gases, after passing through the turbine, are exhausted through area 15. The single-stage, single nozzle combustor and combustion system 13 shown in the prior art were characterized by high NOx emissions which are not suitable for current government regulations on the total emissions allowable from gas turbines when generating electrical power. The present invention provides a solution for the emissions problem by including an improved combustion system with a vertical or silo orientation that greatly reduces NOx emissions while at the same time improving the overall efficiency of the gas turbine engine.

Figure 2:
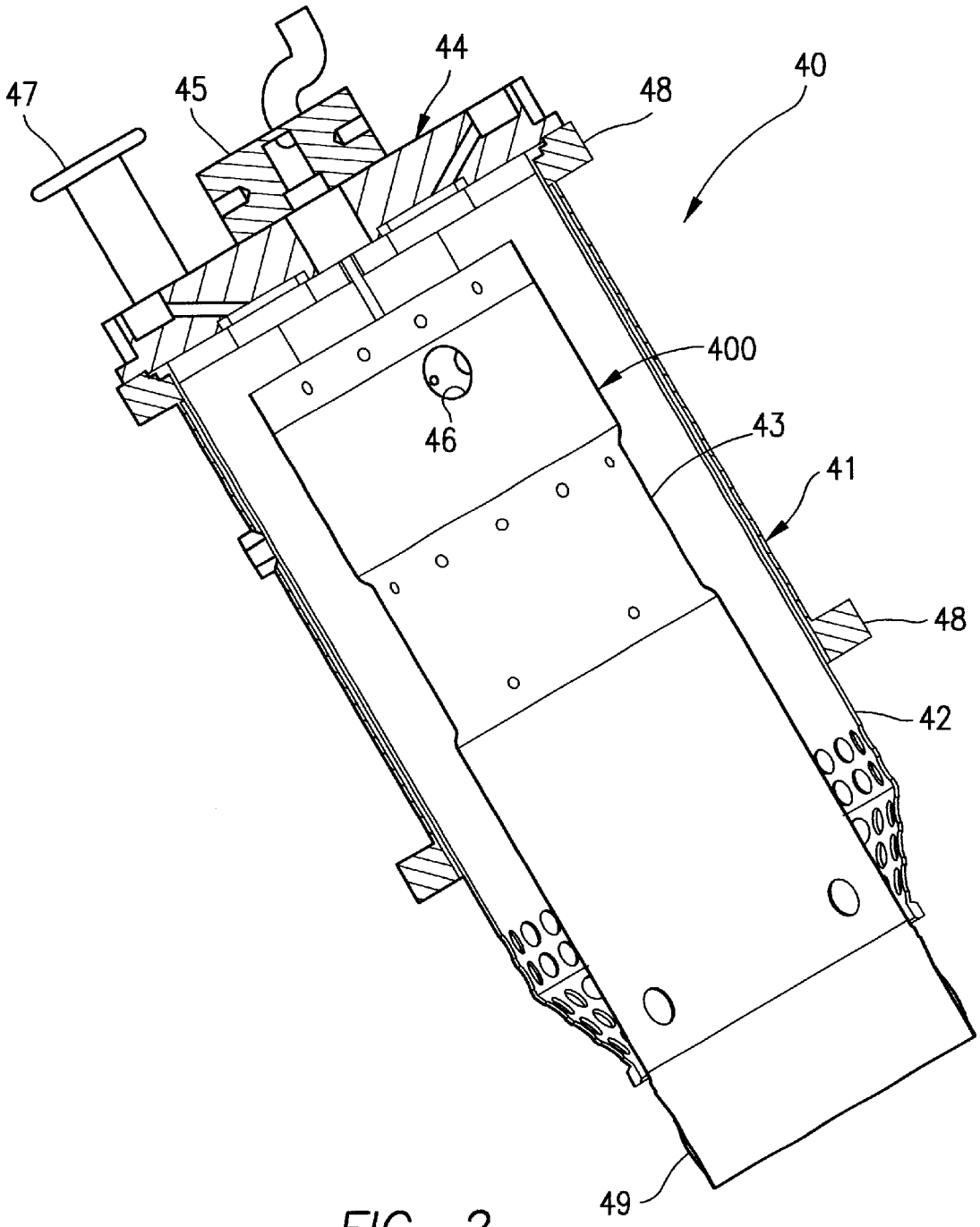
FIG. 2 shows a side elevational view, in cross section of an improved lower emissions can-annular configuration utilized in the present invention.
Figure 5:
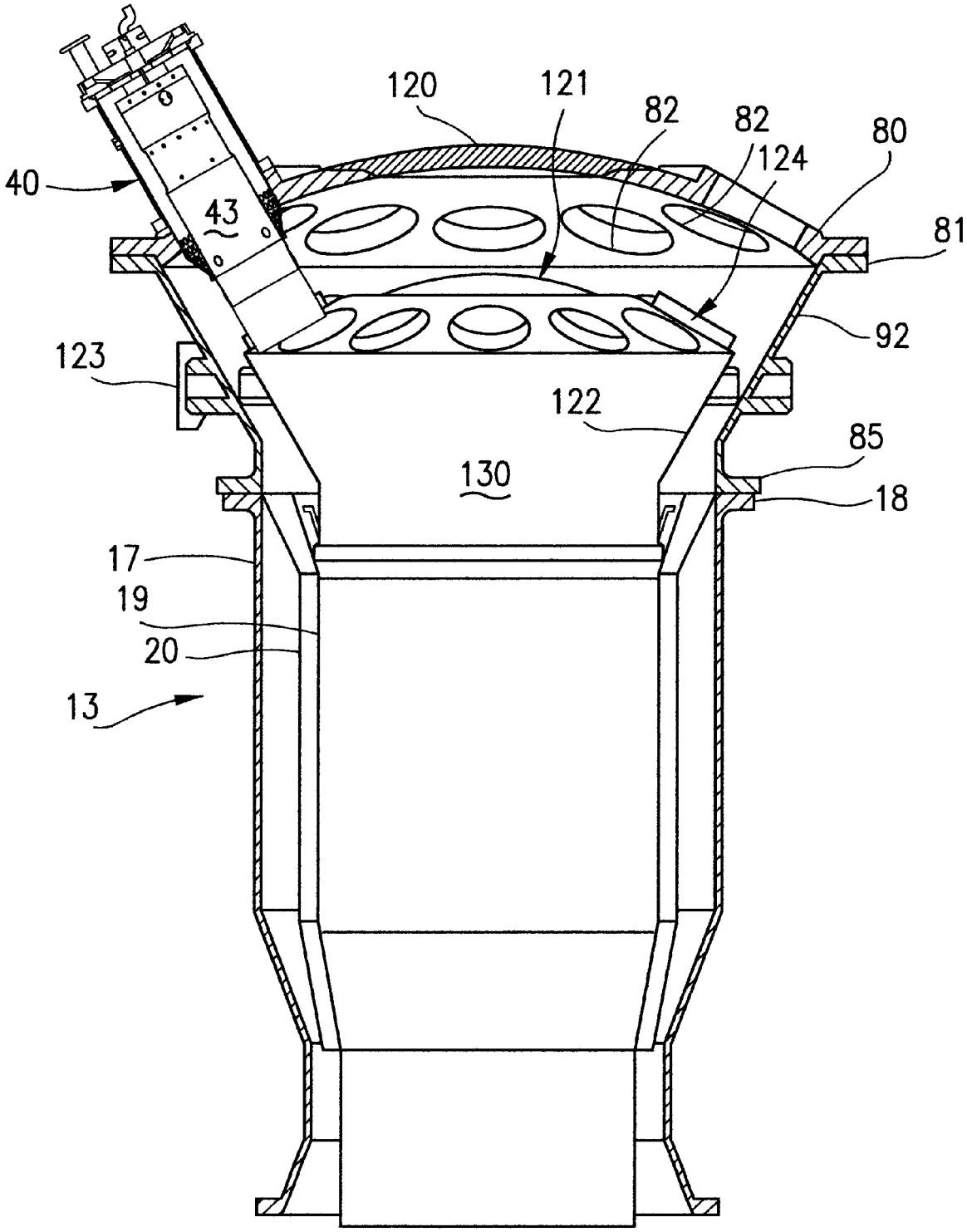
FIG. 5 shows a side elevational view in cross section of the silo combustor system including one individual combustor that is utilized in the present invention.

Referring now to FIG. 2 an individual combustor as utilized in the present invention is shown. The can-annular combustor 40 includes an outer cylindrical case 41 with flanges 48 on each end. These flanges are to be used for mounting and sealing the combustor 40 to mating components described herein. Flow sleeve 42 is used for regulating the amount of compressor discharge air admitted from the compressor to the combustor and retaining the combustor liner 43. The two-stage, two-mode combustion chamber 400 includes and encompasses the first and second stage combustion chambers, cowl cap and the venturi for improved emissions. The combustion chamber 400 is enclosed by cover 44 which includes six primary fuel nozzles (not shown) used for the primary or first stage combustion and second stage fuel supply. Attached to the cover is a central fuel nozzle 45 which is the secondary fuel nozzle for the combustor. This fuel nozzle is used for transition and flame adjustment purposes and is described in applicant's pending patent application for the secondary fuel nozzle. Fuel is supplied to cover 44 through an inlet pipe 47. The can-annular combustors communicate with each other through cross over tubes (not shown) that engage the combustion liner 43 through apertures 46. The bottom portion of combustion liner 43 has a spring seal 49 that is used for sealing, engaging and aligning with the mating inner dome liner attached at the combustor as shown in FIG. 5.

Figure 3:
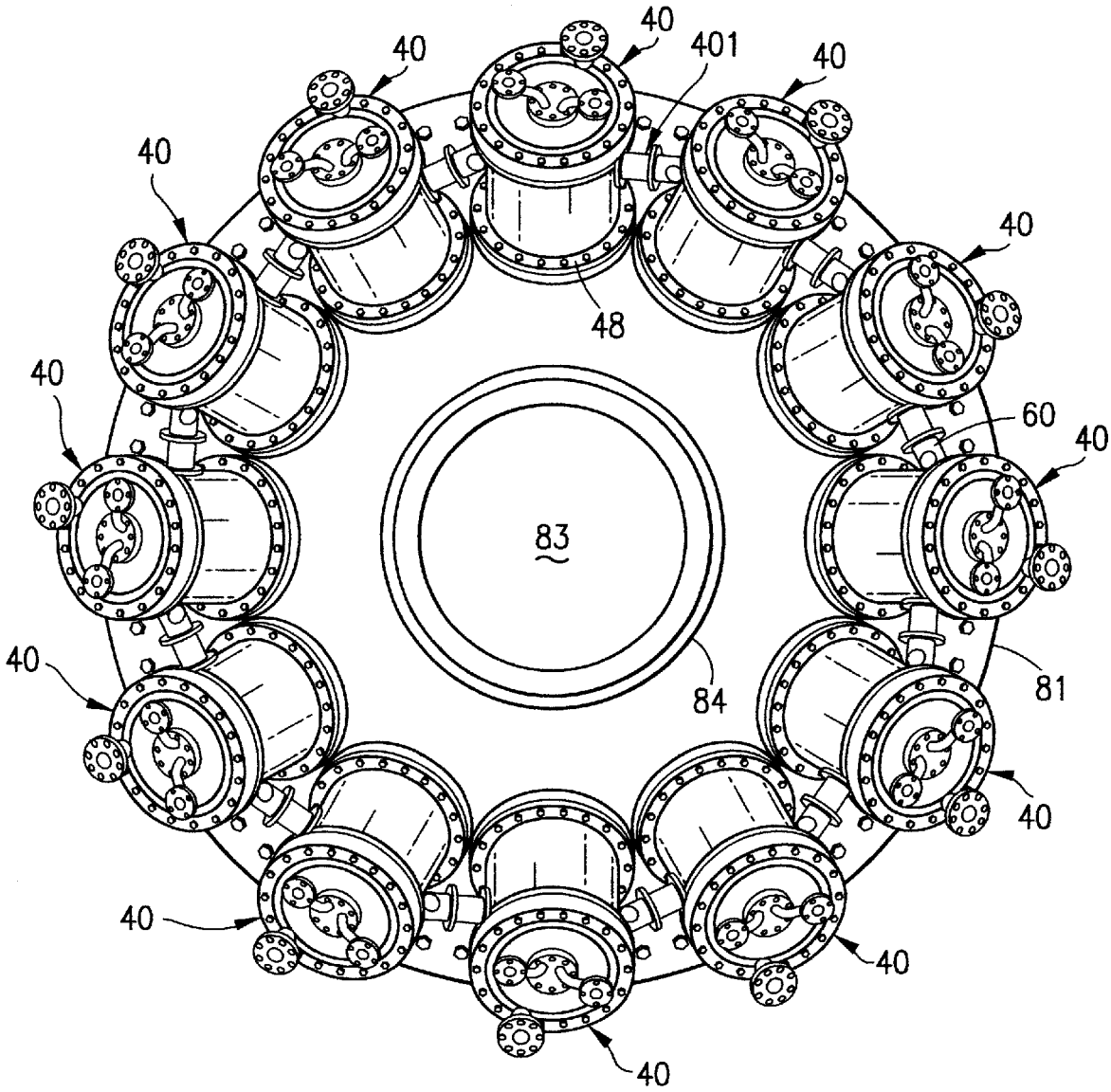
FIG. 3 is a top plan view of the can-annular vertical combustion system utilized in the present invention.

Referring now to FIG. 3, a top plan view of the entire combustion system is shown. As is readily observable, instead of having a single fuel nozzle in a single chamber, the improved silo combustion system includes twelve individual combustors 40 annularly mounted around the top cap 81 of the combustor system. Each individual combustor 40 is a dual stage, dual mode combustor that has reduced NOx emissions. All twelve of the combustors 40 have their outputs into a single plenum. The combustors 40 are mounted essentially vertical on the top cap 81 such that the exhaust gases from each individual combustor 40 are directed downwardly into the plenum chamber which results in a large single exhaust chamber. Cross communication between the combustors are required in order to propagate flame and maintain flame in each individual system. Each individual combustor 40 is in communication with each other via inner and outer tube sections 60 defining the flame crossovers 401. The inner tube carries the flame between combustion liners 43 (FIG. 2) while the outer tube or spool piece, bolts directly to the adjacent combustors 40 by mounting pad 61, shown in FIG. 4. The inner and outer tubes assembly maybe of a fixed or flexible type. A dome lid 83 covers the cap opening used for internal access.

Figure 4:
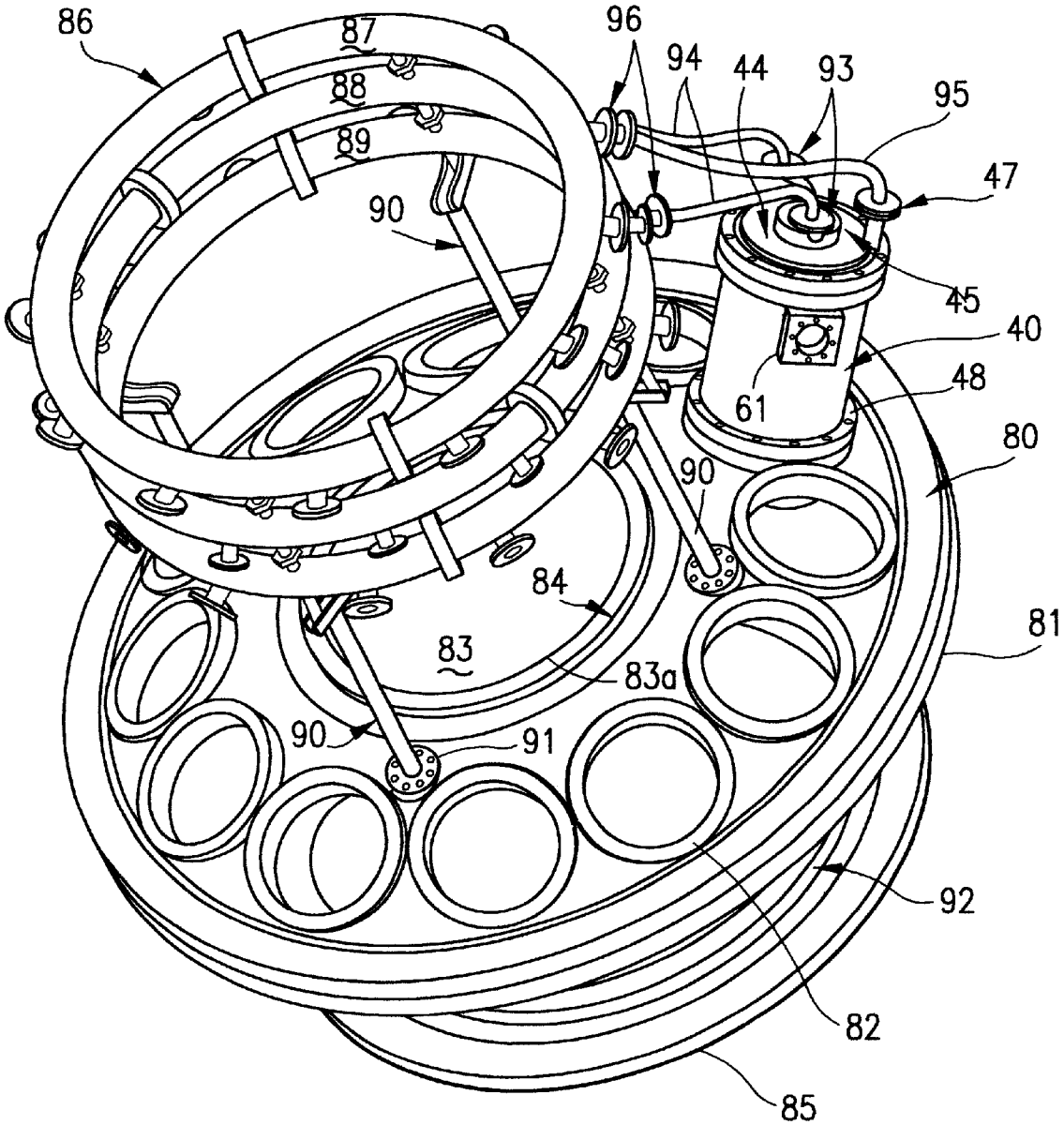
FIG. 4 shows a perspective view of the upper silo case showing only one combustor and the fuel manifold used in the present invention.

Referring to FIG. 4, the combustion system is shown with one combustor 40 for clarity purposes. Each of the combustor mounting bosses (annual rings 82) of which there are 12 disposed around the dome 80 receives its own independent combustor 40. Each can-annular combustor 40 is mounted to the silo dome 80 by an integral mounting boss 82 that is pre-drilled with a matching bolt pattern to the aft flange 48 of combustor 40. Spool pieces for connecting individual combustors 40 are mounted to bosses 61. The silo dome 80 bolts to the upper silo case 92 at flange 81. The upper silo case 92 also contains a lower mounting flange 85, which is annular and which mounts to the silo housing (not shown). The silo housing is mounted vertically and contains the plenum chamber into which all 12 combustors output their combustion gases. The upper dome piece 80 forms a cap for the vertical combustion system.

The fuel manifold system 86 is shown in FIG. 4. In this embodiment a single fuel system is utilized without additional additives such as water, steam or alternate fuels. If additional additives are required, additional manifold plumbing system is necessary. The fuel manifold system is comprised of multiple manifolds 87,88, and 89 each of which carry fuel to different locations of the combustor 40. Natural gas fuel is introduced to the manifolds from ground fed piping (not shown) which would typically arrive from a natural gas pipeline. The natural gas fuel is transferred to the combustor 40 through flexible houses 94 and 95 that are attached to the manifolds 87,88, and 89 and to the cover 44 and central fuel nozzle base 45. The flexible hoses 94 and 95 are attached to the manifold and combustor by flanges. The fuel manifold system 86 is supported over the combustion system cap by rigid beam assembly 90 which can be mounted to the dome 80 by mounting flanges 91 or to a surrounding maintenance catwalk. Access to the combustor 40 for maintenance and inspection is achieved through an opening 83 that is covered by a dome lid 83*a* which would normally cover opening 83 and which is mounted directly to an annular flange 84 connected to the combustion system dome 80.

Referring now to FIG. 5, the vertical combustion system is shown containing one combustor 40 with the other combustors removed for clarity. The embodiment shown in FIG. 5 also does not include the fuel manifold system as shown in FIG. 4. The combustion system 13 as shown operates in a vertical position relative to the turbine shaft that operates horizontally relative to the ground. In operation the combusted gases that power the turbine are directed in a downward direction. As described above, with respect to FIG. 1 and the turbine section and the compressor section, the vertical silo combustion system 13 is perpendicular to the linear axis and power shaft 12*a* that connects the turbine system with the compressor system. Because the flow of the combustion gases is downward and the overall height of the silo is increased, it is believed that the vertical orientation that includes having multiple individual combustors 40 provide a uniform gas mixing process for lower Nox emissions. Each of the individual combustors 40 are dual stage, dual mode combustors having very low pollutant emissions of nitric oxides. As shown in FIG. 5, each of the openings at mount 82 receive an individual combustor 40, with a total of 12 individual combustors 40. Combustion gas from each individual combustor 40 is forced under pressure downwardly and into the plenum chamber 130. The combustion system 13 is comprised of a lower case 17 that is vertically oriented and attached to the turbine and compressor sections of the engine. The combustor system 13 includes a middle flow sleeve 20 and a ribbed inner liner 19. The can-annular combustion assembly 40 is mounted to the silo combustion system case 17 at flange 18. The upper silo case 92 is mounted to the lower silo case 17 using flanges 18 and 85. The silo dome 80 is mounted to the upper silo case 92 at flange 81. The inner dome liner 122 is positioned inside the upper silo case 92 for the purpose of receiving the hot gases from the individual combustors 40 and directing these gases into the plenum chamber 130.

The inner dome liner 122 is held in place and positioned within the upper silo case 92 by four positioning members 123. These positioning members 123 are adjustable to compensate for tolerances, assembly and operational variations. The inner dome liner openings 124 allow for receipt of the combustor liner 43. The interface is completely sealed by a spring seal 49 which is integral to the combustion liner 43. Hot gases exit individual combustion liners 43 into the inner dome liner 122 which transfers the flow of hot gases to the silo combustion system inner liner 19. The inner dome liner 122 and the dome 80 each have lids 121 and 120 respectively that can be removed for maintenance, inspection and assembly purposes.

Figure 6:
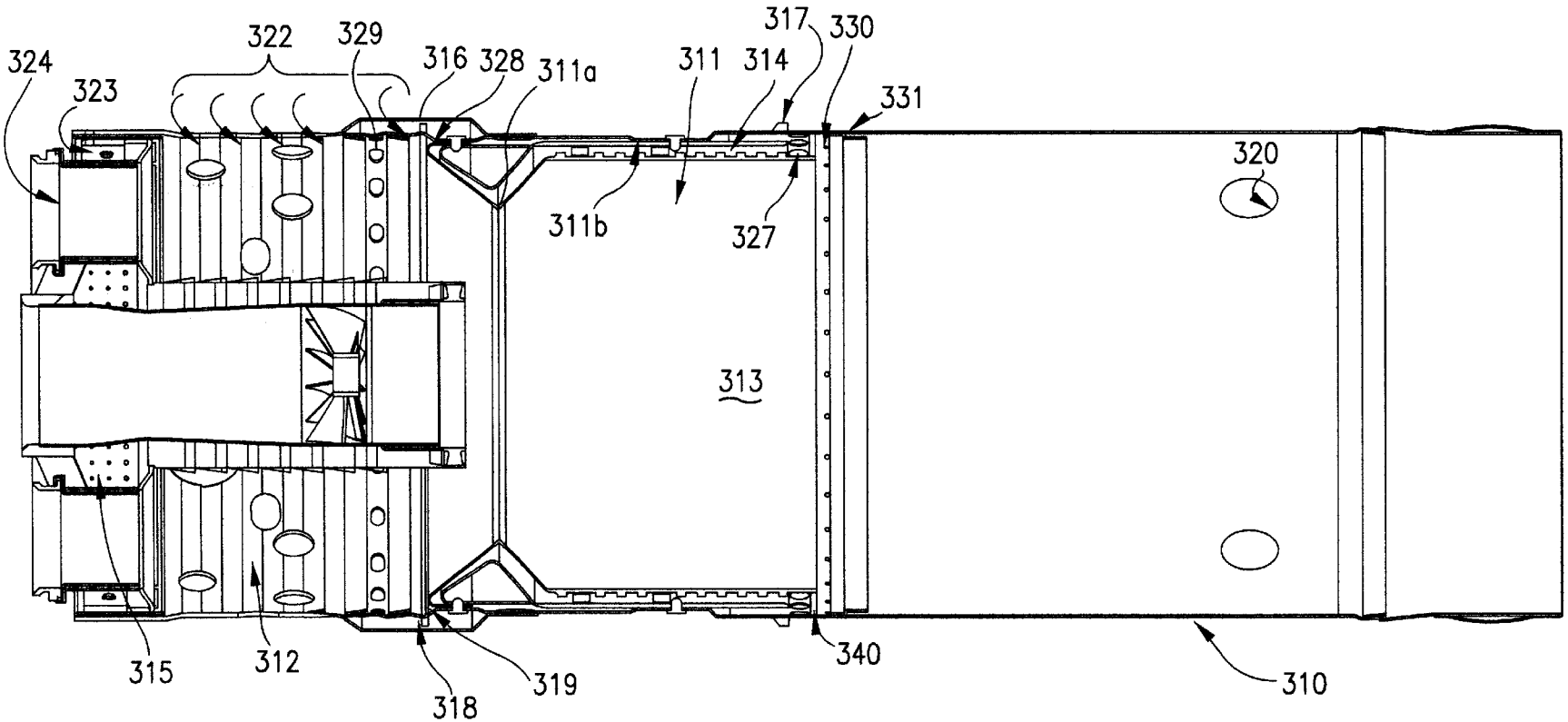
FIG. 6 shows a side elevation view, partially in cross section of a dual stage, dual mode combustor of the type utilized in the present invention.

Referring now to FIG. 6, an improved combustor that is used in the present invention is shown at 310 including a combustor chamber 313 that has a venturi 311*a*. This combustors described in Applicant's pending U.S. patent application Ser. No. 09/605,765 entitled "Combustor Chamber/Venturi Cooling For A Low NOx Emission Combustor", filed Jun. 28, 2000 incorporated by reference herein.

The combustor chamber wall 311 includes a cylindrical portion which forms the combustor chamber 113 and unitary formed venturi walls which converge and diverge in the downstream direction forming an annular or circular restricted throat 311*a*. The purpose of the venturi and the restricted throat 311*a* is to prevent back flash of the flame from the combustion chamber 313.

Chamber 312 is the premix chamber where air and fuel are mixed and forced under pressure downstream through the venturi throat 311*a* into the combustion chamber 313.

Concentric, partial cylindrical wall 311*b* surrounds the combustor chamber wall 311 including the converging and diverging venturi wall to form an air passage 314 between the combustor chamber wall 311 and the concentric wall 311*b* that allows the cooling air to pass along the outer surface of the combustion chamber walls 311 to cool the walls 311, 311*b*.

The outside of the combustor 310 is surrounded by a housing (not shown) and contains air under pressure that moves upstream towards the premix zone 312, the air being received from the compressor of the turbine. This is very high pressure air. The air-cooling passage 314 has air inlet apertures 327 which permits the high-pressure air surrounding the combustor to enter through the apertures 327 and to be received in the entire annular passage 314 that surrounds the combustion chamber wall 311. The cooling air passes along the combustion chamber wall 311 passing the venturi converging and diverging wall in venturi throat 311*a*. Preheated cooling air exits through outlet 328 which exits into an annular belly band chamber 316. The combustor utilizes the cooling air that has been heated and allowed to enter into premix chamber 312 through apertures 329 and 322. Note that this is heated air that has been used for cooling that is now being introduced into the premix chamber, upstream of the convergent wall of the venturi and the upstream of venturi throat 311*a*. Using preheated air drives the f/a ratio to a lean limit to reduce NOx while maintaining a stable flame. The combustor shown in FIG. 6 herein can be utilized as each of the twelve individual combustors 40 shown in FIG. 3. These combustors are found to increase the efficiency and reduce emissions of NOx in the vertical silo combustor system described herein. Each combustor 40 provides combustion gases into a central plenum.

With the use of a vertical combustion system in a gas turbine engine having the turbine section and the compressor section horizontal in a linear axial alignment and employing individual combustors that are two-stage, provides for a highly efficient gas turbine engine with very low NOx emissions. The combustion gases from each individual combustor 40 is directed into a single plenum chamber which itself empties into an annular chamber providing a 360 degree area of impinging gases for rotating the turbine blades.

The instant invention has been shown and described herein in what is considered to be the most practical and preferred embodiment. It is recognized, however, that departures may be made there from within the scope of the invention and that obvious modifications will occur to a person skilled in the art.

What is claimed is:

1. A gas turbine engine for generating electricity with low NOx emissions comprising:

a turbine system for providing rotational energy;

a compressor system for providing compressed air connected to said turbine system;

a linear shaft connecting said turbine system to said compressor system;

a vertically oriented combustion system connected in fluid communication with said compressor system and said turbine system for providing combustion gases for driving said turbine system;

said combustion system comprising a combustion generating section for generating combustion gases, a mounting system for attaching said combustion generating system to said engine, and a plenum chamber for receiving said combustion gases;

said combustion generating section including a plurality of dual stage, dual mode combustors having low NOx emissions that are in communication with each other, each combustor containing a plurality of fuel nozzles, an upstream/premix combustion chamber and a downstream/secondary combustion chamber separated from said premix chamber by a venturi section;

said mounting system for a combustion generating section including a silo dome, upper silo case, and inner dome liner; said silo dome and said inner dome liner each contain a plurality of openings in a circular array for accepting said dual stage, dual mode combustors;

said mounting system connected to said plenum chamber, the output of said plenum chamber connected to said turbine section through an annular 360 degree ring to said turbine section;

said combustion generating system where in the combustion process of mixing fuel and air and igniting the mixture is contained within both stages of said dual stage, dual mode combustor such that the hot combustion gases exiting each of said combustors mixes in said plenum chamber prior to entry into said turbine system.

2. A gas turbine engine as in claim 1, wherein said dual stage, dual mode combustors mounted to said silo dome at an angle not to exceed 90 degrees from the vertical.

* * * * *